US008072124B2

(12) United States Patent
Liu et al.

(10) Patent No.: US 8,072,124 B2
(45) Date of Patent: Dec. 6, 2011

(54) LED TUBE LAMP WITH HEAT DISSIPATING MEMBER

(75) Inventors: Tay-Jian Liu, Taipei Hsien (TW); Tao-Ping Zhou, Shenzhen (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 274 days.

(21) Appl. No.: 12/540,333

(22) Filed: Aug. 12, 2009

(65) Prior Publication Data

US 2010/0171404 A1 Jul. 8, 2010

(30) Foreign Application Priority Data

Jan. 7, 2009 (CN) ..... 2009 1 0300095

(51) Int. Cl.
*H01J 1/02* (2006.01)
*H01J 7/24* (2006.01)
*H01J 61/52* (2006.01)
*H01K 1/58* (2006.01)

(52) U.S. Cl. ..... 313/46; 362/221; 362/219

(58) Field of Classification Search ..... 313/46; 362/221, 217.01, 219, 223
See application file for complete search history.

(56) References Cited

U.S. PATENT DOCUMENTS 6,208,073 B1 * 3/2001 Wang et al. ..... 313/500
6,361,186 B1 * 3/2002 Slayden ..... 362/241
6,776,504 B2 * 8/2004 Sloan et al. ..... 362/240
7,267,461 B2 * 9/2007 Kan et al. ..... 362/373
7,549,778 B2 * 6/2009 Chien ..... 362/396
7,572,027 B2 * 8/2009 Zampini et al. ..... 362/225
7,594,738 B1 * 9/2009 Lin et al. ..... 362/249.02
7,857,482 B2 * 12/2010 Reo et al. ..... 362/225
7,862,195 B2 * 1/2011 Stack et al. ..... 362/125
2002/0044456 A1 * 4/2002 Balestriero et al. ..... 362/555
2003/0185014 A1 * 10/2003 Gloisten ..... 362/372
2006/0146531 A1 * 7/2006 Reo et al. ..... 362/244
2007/0285922 A1 * 12/2007 Chen ..... 362/240
2008/0037239 A1 * 2/2008 Thomas et al. ..... 362/92
2009/0310354 A1 * 12/2009 Zampini et al. ..... 362/235
2010/0102729 A1 * 4/2010 Katzir et al. ..... 315/113
2010/0320891 A1 * 12/2010 Liu et al. ..... 313/46

* cited by examiner

*Primary Examiner* — Nimeshkumar Patel
*Assistant Examiner* — Glenn Zimmerman
(74) *Attorney, Agent, or Firm* — Altis Law Group, Inc.

(57) ABSTRACT

An LED lamp includes a light-emitting module, an electrical module and an elongated heat dissipating member. The light-emitting module includes a light source provided with a plurality of LEDs. The electrical module includes a circuit board electrically connected with the LEDs of the light source and two end caps each forming a pair of electrical pins at an outer end thereof. The heat dissipating member is arranged between and connecting with the two end caps, the heat dissipating member is a hollow metal tube and includes a mounting portion and a heat dissipating plate extending from the mounting portion. The mounting portion and the heat dissipating plate cooperatively define an elongate chamber. The circuit board is accommodated in the chamber of the heat dissipating member. The light source is thermally attached to an outer surface of the mounting portion.

10 Claims, 7 Drawing Sheets

LED TUBE LAMP WITH HEAT DISSIPATING MEMBER

BACKGROUND

1. Technical Field

The present disclosure relates to light emitting diode (LED) lamps, and particularly to an LED lamp with high heat dissipating efficiency.

2. Description of Related Art

In recent years, LEDs are preferred for use in lamps rather than CCFLs (cold cathode fluorescent lamps) and other traditional lamps due to their excellent properties, including high brightness, long lifespan, directivity, and etc.

For an LED, about eighty percents of the power consumed thereby is converted into heat. Generally, an LED lamp includes a plurality of LEDs arranged on a substrate to obtain a desired brightness and illumination area. However, the plurality of LEDs generate a large amount of heat during operation which endangers the normal operation of the LEDs of the LED lamp. A highly efficient heat dissipation device is necessary in order to timely and adequately remove the heat generated by the LED lamp. Otherwise, the brightness, lifespan, and reliability of the LED lamp will be seriously affected.

For the foregoing reasons, therefore, there is a need in the art for an LED lamp which overcomes the limitations described.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
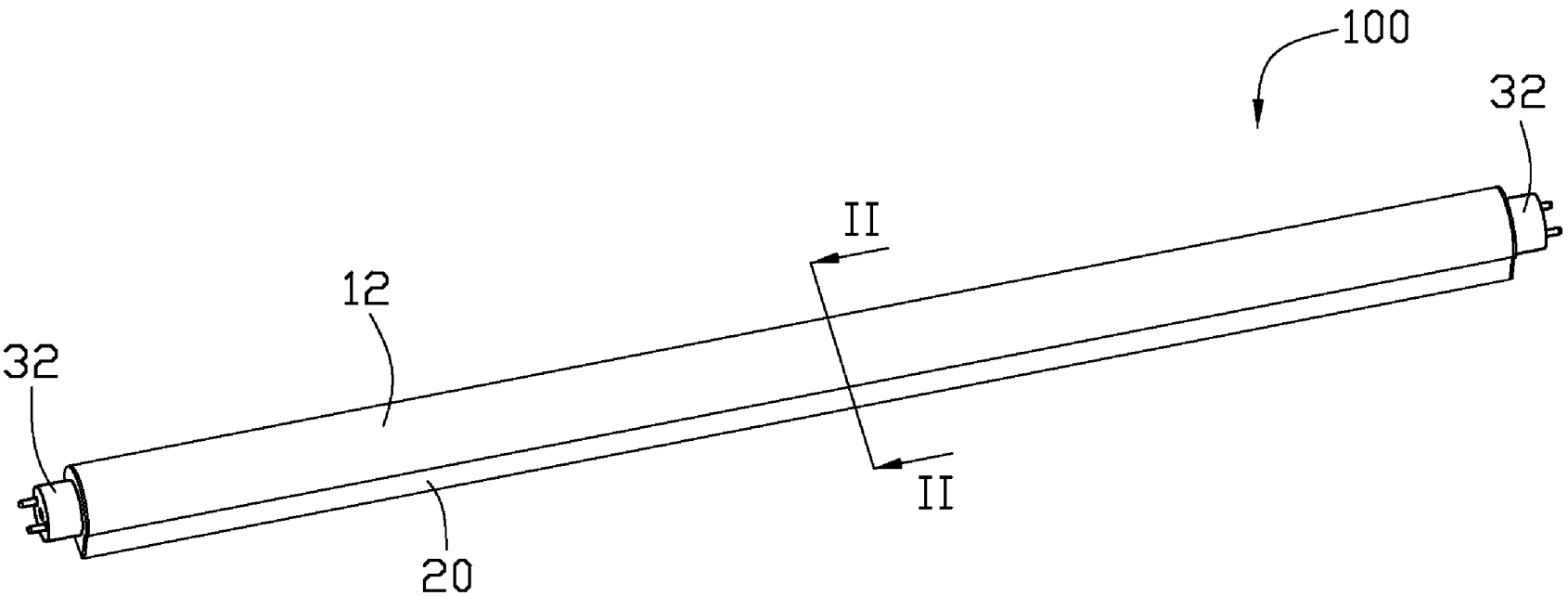
FIG. 1 is an assembled, isometric view of an LED lamp in accordance with a first embodiment.
Figure 2:
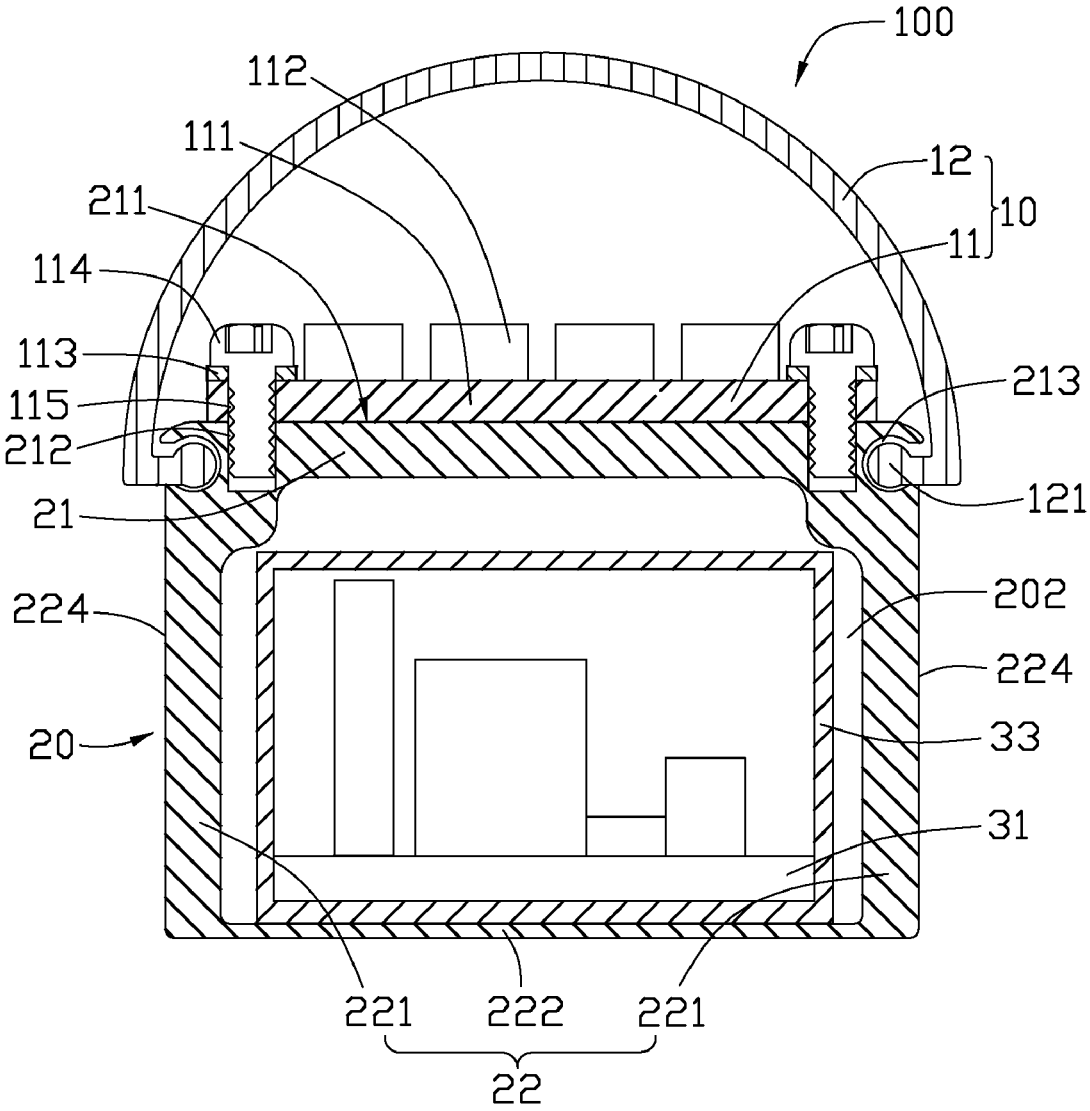
FIG. 2 is an enlarged, cross-sectional view of the LED lamp of FIG. 1, taken along line II-II thereof.

Referring to FIGS. 1 and 2, an LED lamp 100 according to an exemplary embodiment includes a heat dissipating member 20, a light-emitting module 10, and an electrical module electrically connected with the light-emitting module 10.

The heat dissipating member 20 is an elongated, hollow metal tube. A cross section of the heat dissipation member 20 is substantially rectangular. An elongated rectangular chamber 202 is defined in the heat dissipating member 20. The heat dissipating member 20 includes a mounting portion 21 and a generally U-shaped heat dissipating portion 22 connecting with the mounting portion 21. The mounting portion 21 is a flat plate and forms a heat absorbing surface 211 at a top outer side thereof. A plurality of fixing holes 212 are defined in the mounting portion 21 and located adjacent to two opposite lateral sides (i.e., left and right sides shown in FIG. 2) of the mounting portion 21. The mounting portion 21 further defines two receiving grooves 213 in the two opposite lateral sides thereof, respectively. The heat dissipating portion 22 includes two side plates 221 and a connecting plate 222. The two side plates 221 extend vertically and downwardly from the two lateral sides of the mounting portion 21, respectively. The connecting plate 222 is parallel to the mounting portion 21 and connected between bottom ends of the two side plates 221. In this embodiment, the mounting portion 21 and the heat dissipating plate 22 of the heat dissipating member 20 are integrally formed as a monolithic piece so as to reduce a thermal resistance therebetween. Alternatively, the heat dissipating plate 22 of the heat dissipating member 20 can be formed separately from the mounting portion 21 and then secured to the mounting portion 21 by, for example, welding. Furthermore, except the disclosed U-shaped configuration, the heat dissipating plate 22 can have other shapes, such as arc shape.

The light-emitting module 10 includes a light source 11 provided with a plurality of LEDs 112 (light emitting diodes), and an elongated light penetrable cover 12. The light source 11 is attached to the heat absorbing surface 211 of the mounting portion 21 of the heat dissipating member 20.

The light source 11 includes an elongated substrate 111 forming circuits thereon, and a plurality of electrodes formed on the substrate 111 connected with the circuits. The plurality of LEDs 112 are arranged on the substrate 111 and evenly spaced from each other. The LEDs 112 are electrically connected to the electrical circuits formed on the substrate 111. A plurality of through holes 115 are defined near two opposite lateral sides of the substrate 111 corresponding to the fixing holes 212 of the mounting portion 21. A plurality of screws 114 respectively extend through the through holes 115 of the substrate 111 of the light source 11 and respectively threadedly engage into the fixing holes 212 of the mounting portion 21, to thereby securely attach the light source 11 to the heat absorbing surface 211 of the mounting portion 21. Further, an electrical insulating washer 113 is arranged between a head of each screw 114 and a top surface of the substrate 111 to insulate the screws 14 from the circuits of the substrate 111.

When the light source 11 is mounted to the heat absorbing surface 211 of the mounting portion 21, a layer of thermal interface material (TIM) may be applied between the substrate 111 and the heat absorbing surface 211 to eliminate an air interstice therebetween, to thereby enhance a heat conduction efficiency between the light source 11 and the mounting portion 21. Alternatively, the substrate 111 of the light source 11 can be attached to the heat absorbing surface 211 of the mounting portion 21 fixedly and intimately through surface mount technology (SMT). Still alternatively, the substrate 111 can be omitted and the circuits of the substrate 111 are integrally formed on the mounting portion 21 of the heat dissipating member 20, whereby a thermal barrier caused by the substrate 111 can be eliminated and a thermal resistance between the LEDs 112 and the mounting portion 21 of the heat dissipating member 20 is reduced. In this alternative embodiment, the heat generated by the LEDs 112 can be directly transferred to the mounting portion 21.

The light penetrable cover 12 is located above the light source 11 and mounted to the mounting portion 21 of the heat dissipating member 20. The light penetrable cover 12 receives the light source 11 therein and functions as an optical lens for the LEDs 112 of the light source 11. Light emitted by the LEDs 112 of the light source 11 is guided to environment by the light penetrable cover 12. The light penetrable cover 12 is substantially C-shaped and forms two protrusions 121 at two opposite lateral sides thereof corresponding to the receiving grooves 213 of the mounting portion 21. Each of the protrusions 121 extends horizontally and inwardly from a corresponding lateral side of the light penetrable cover 12. The light penetrable cover 12 is mounted to the mounting portion 21 of the heat dissipating member 20 via an engagement between the protrusions 121 of the light penetrable cover 12 and the receiving grooves 213 of the mounting portion 21.

Figure 3:
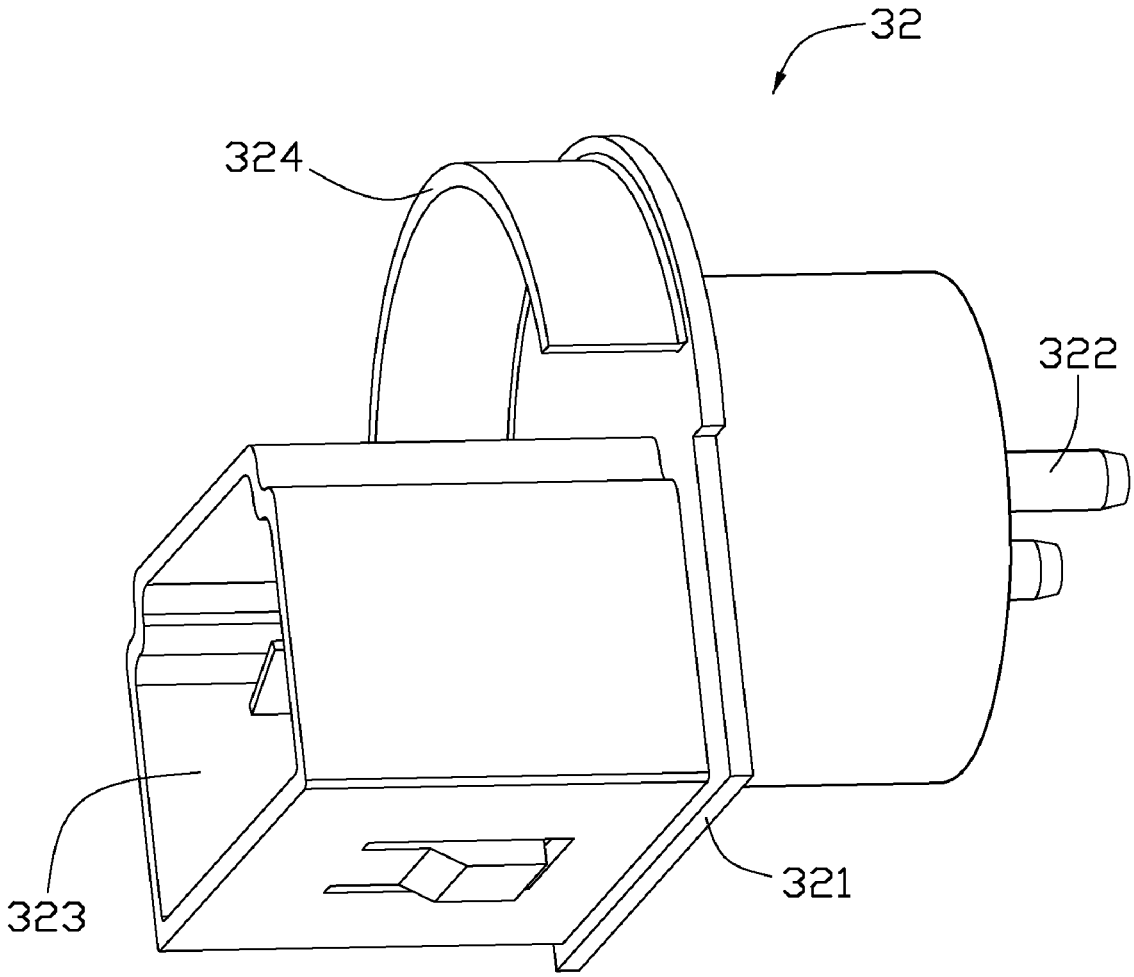
FIG. 3 is an isometric view of an end cap of the LED lamp of FIG. 1.

The electrical module, which provides drive power, control circuit and power management for the light source 11, includes a circuit board 31, and two end caps 32. The circuit board 31 is enclosed by a rectangular electrical insulator 33. The circuit board 31 and the electrical insulator 33 are accommodated in the chamber 202 of the heat dissipating member 20. The light-emitting module 10 and the heat dissipating member 20 are arranged between the two end caps 32 of the electrical module. Referring to FIG. 3, each end cap 32 includes a vertical blocking plate 321, a hollow rectangular connecting member 323 and an arc-shaped positioning member 324 formed at an inner side of the blocking plate 321 which faces the heat dissipating member 10, and a pair of electrical pins 322 located at an outer side of the blocking plate 321. The pair of electrical pins 322 of each end cap 32 can be used for engaging with a traditional fluorescent lamp holder 40 (FIG. 4) to mount the LED lamp 100 thereon. The circuit board 31 electrically connects with the electrodes of the light source 11 and the electrical pins 322 of the end caps 32 via a plurality of electrical wires, whereby the LEDs 112 of the LED lamp 100 can get power from an external power source via the lamp holders 40 which are connected to the two end caps 32. The connecting member 323 and the positioning member 324 are respectively inserted in the heat dissipating member 20 and the light penetrable cover 12, and respectively contact with inner surfaces of the heat dissipating member 20 and the light penetrable cover 12, to thereby seal ends of the light-emitting module 10 and the heat dissipating member 20.

During operation, the circuit board 31 is electrically connected to the light source 11 and the electrical pins 322 of the end caps 32, whereby an external power source can supply electric current to the LEDs 112 through the electrical pins 322 and the circuit board 31 to cause the LEDs 112 to emit light. The light of the LEDs 112 travels through the light penetrable cover 12 to an outside for lightening.

A large amount of heat is generated by the LEDs 112 during the operation of the LED lamp 100. As the light source 11 is attached to the mounting portion 21 of the heat dissipating member 20, the heat generated by the LEDs 112 of the light source 11 is quickly absorbed by the mounting portion 21. The heat absorbed by the mounting portion 21 is rapidly transferred to the two side plates 221 of the heat dissipating plate 22 for dissipation. Outer surfaces 224 of the two side plates 211 provide a larger area for exchanging heat with ambient atmosphere. Thus, the LEDs 112 of the light source 11 can be kept working at a lower temperature, and the brightness, lifespan, and reliability of the LED lamp 100 will be improved.

In this embodiment, the tubular heat dissipating member 20 isolates the circuit board 31 from an outer environment to protect the circuit board 31. A metal peripheral wall of the heat dissipating member 20 functions as electromagnetic radiation shielding for the circuit board 31, to thereby make sure of the electric safety and stability of the LED lamp 100. The tubular heat dissipating member 20 receives the circuit board 31 and the electrical wires therein, which reduces the space occupied by the LED lamp 100 and enables the LED lamp 100 to have a compact and aesthetic appearance.

Figure 4:
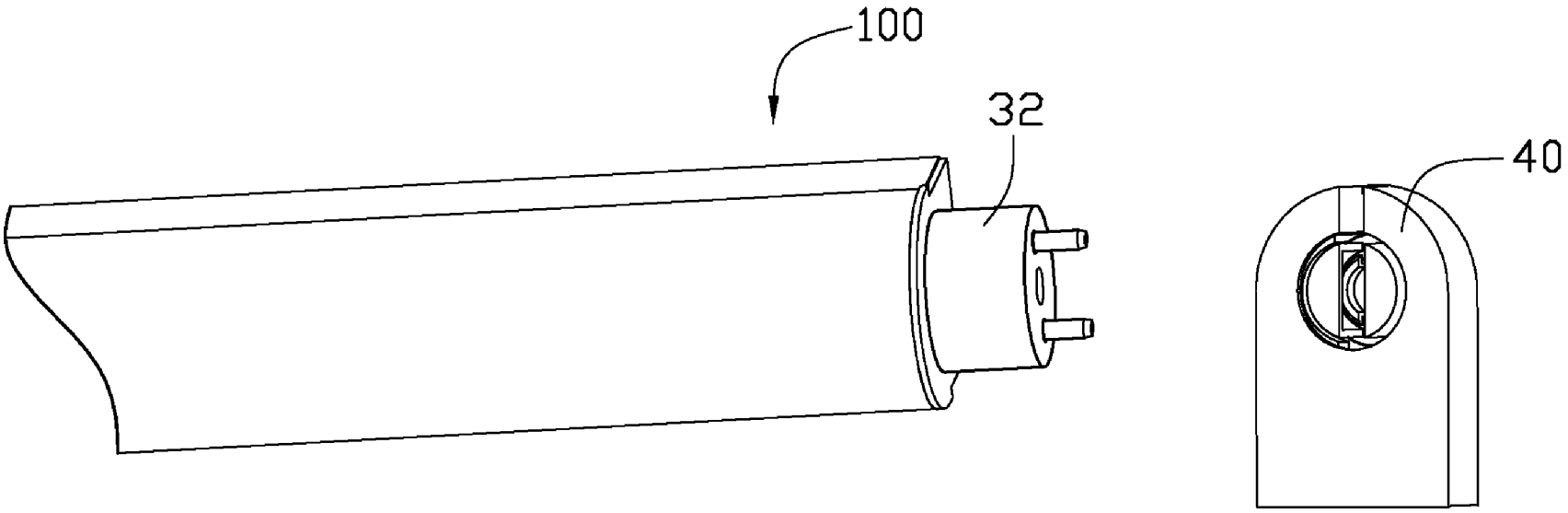
FIG. 4 shows a part of the LED lamp and a lamp holder for the LED lamp.
Figure 5:
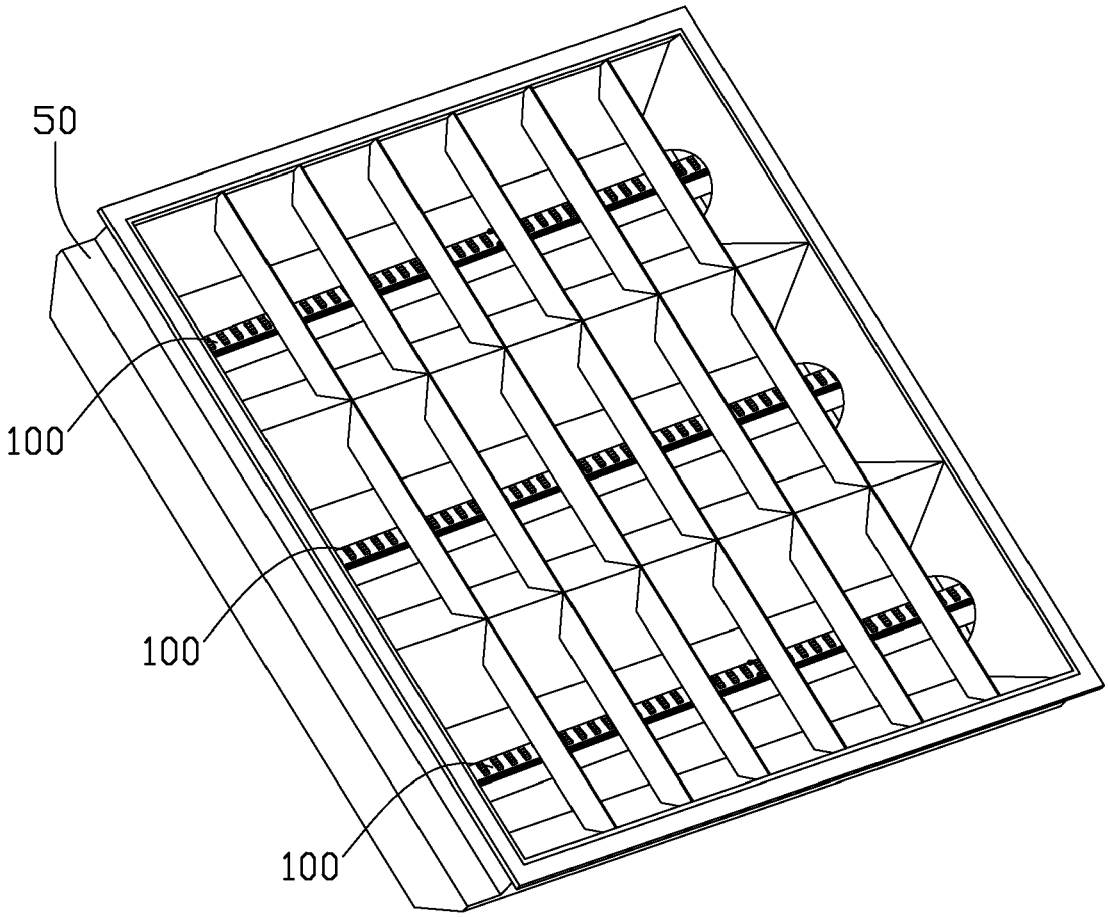
FIG. 5 shows a ceiling-mounted LED lamp assembly consisting of a plurality of the LED lamps of FIG. 1 mounted in a lamp frame.

Referring to FIG. 4, the LED lamp 100 can be mounted on the traditional fluorescent lamp holders 40 (only one lamp holder 40 in FIG. 4 being shown) via the electrical pins 322 of the two end caps 32, to thereby replace the traditional fluorescent lamp, which reduces the manufacturing and mounting cost of the LED lamp 100, and enables the LED lamp 100 to replace the traditional fluorescent lamp easily. Referring to FIG. 5, a plurality of LED lamps 100 shown in FIGS. 1-2 can be mounted on a lamp frame 50 formed by aluminum extrusion to form an LED lamp assembly to enhance an illumination intensity. The lamp frame 50 is originally used for mounting traditional fluorescent lamps. The LED lamp assembly so constructed is used as a ceiling-mounted lamp assembly.

Figure 6:
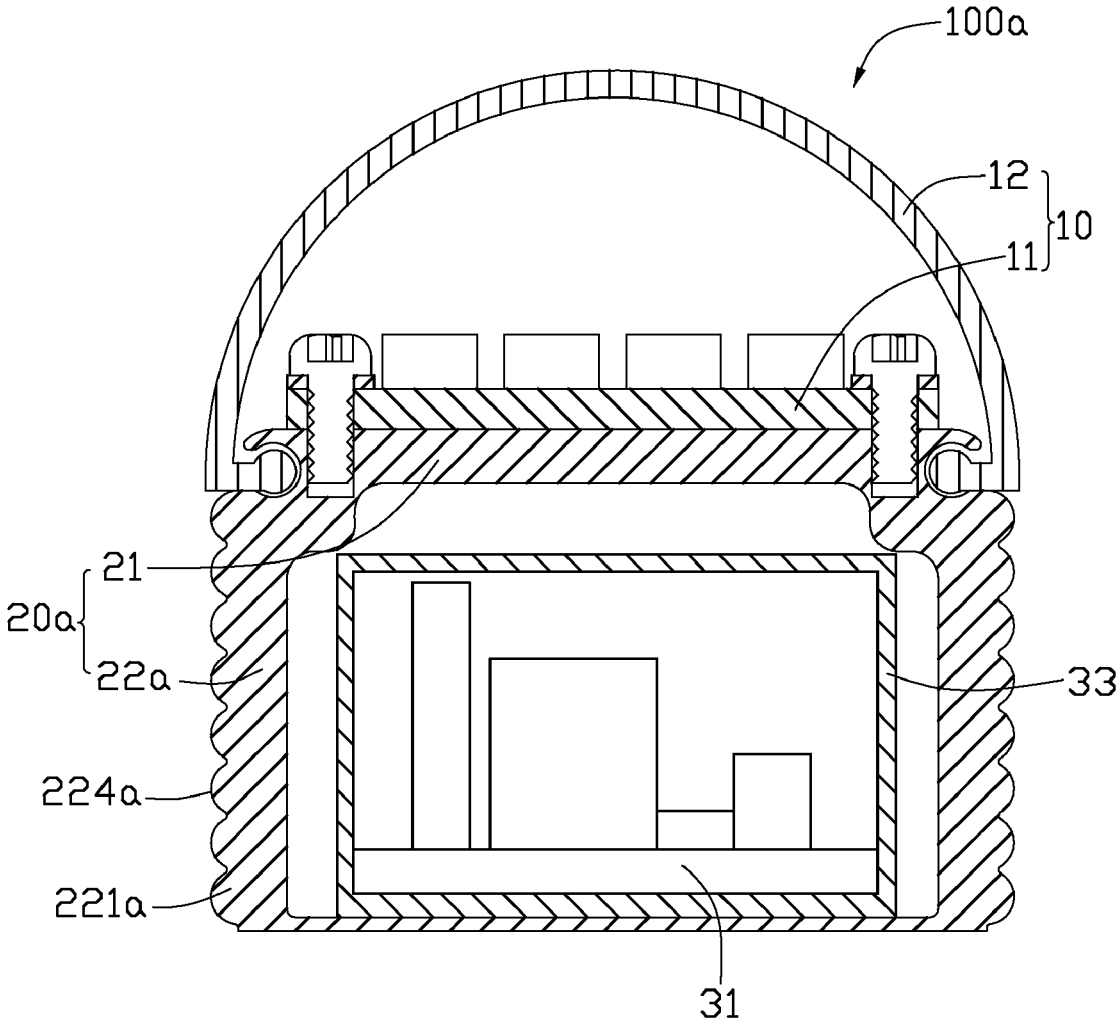
FIG. 6 is a cross-sectional view of an LED lamp in accordance with a second embodiment.

Referring to FIG. 6, an LED lamp **100*a* according to a second embodiment is illustrated. The difference between this LED lamp 100*a* and the LED lamp 100 illustrated in FIGS. 1-2 lies in the heat dissipating member 20*a*. In this embodiment, an outer surface 224*a* of each side plate 221*a* of a heat dissipating plate 22*a* of the heat dissipating member 20*a* is wave-shaped, and includes a plurality of arc-shaped sections connecting with each other. Thus an area of the heat dissipating plate 22*a* of the heat dissipating member 20*a* used for exchanging heat with ambient atmosphere is greatly increased without increasing the size and weight of the heat dissipating member 20*a***.

Figure 7:
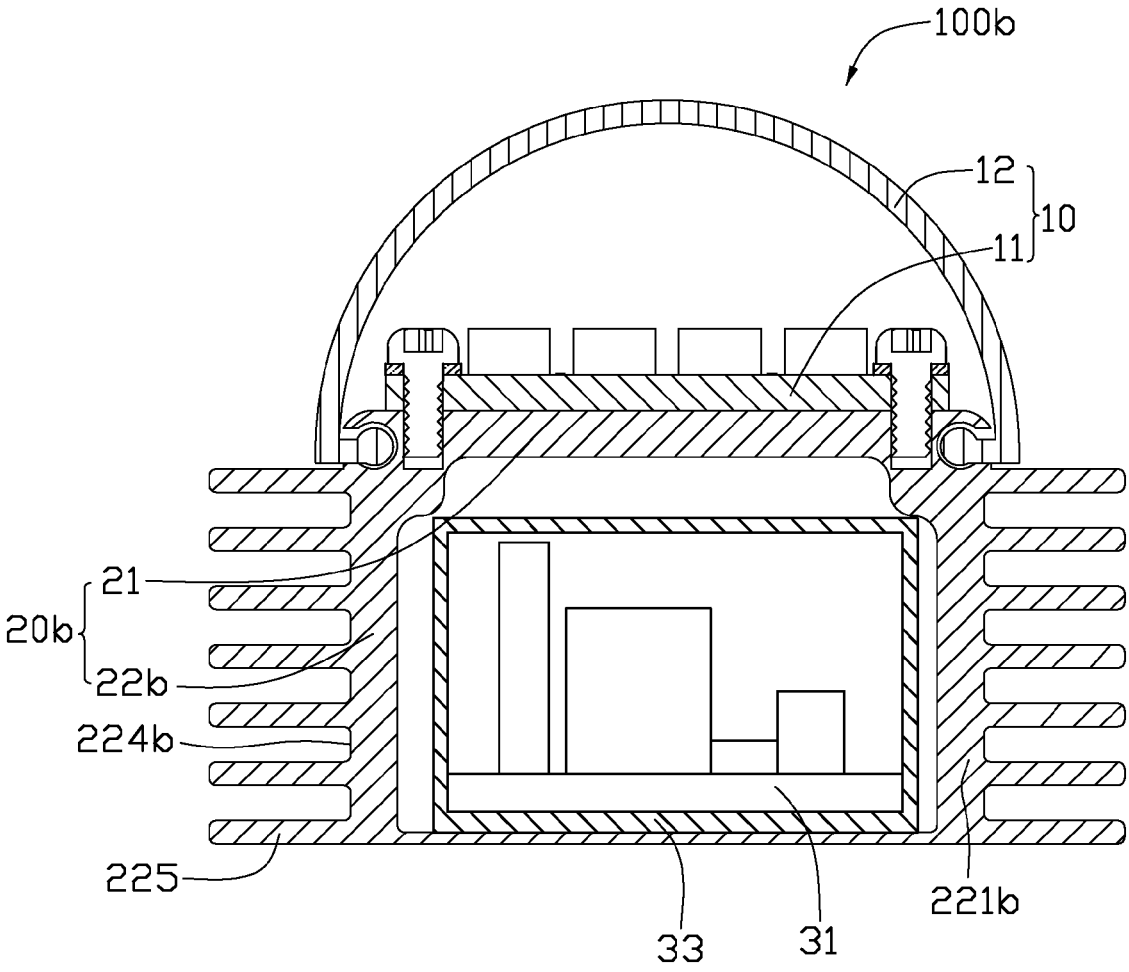
FIG. 7 is a cross-sectional view of an LED lamp in accordance with a third embodiment.

Referring to FIG. 7, an LED lamp **100*b* according to a third embodiment is illustrated. The difference between this LED lamp 100*b* and the LED lamp 100 illustrated in FIGS. 1-2 lies in the heat dissipating member 20*b*. In this embodiment, a plurality of fins 225 are formed on an outer surface 224*b* of each side plate 221*b* of a heat dissipating plate 22*b* of the heat dissipating member 20*b*. Thus an area of the heat dissipating plate 22*b* of the heat dissipating member 20*b*** used for exchanging heat with ambient atmosphere is greatly increased, and a heat dissipation efficiency of the LED lamp is enhanced.

It is to be understood, however, that even though numerous characteristics and advantages of the disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED lamp, comprising:

a light-emitting module comprising a light source provided with a plurality of LEDs;

an electrical module comprising a circuit board and two end caps, the circuit board being electrically connected with the LEDs of the light source, each of the end caps forming a pair of electrical pin at an outer end thereof;

an elongated heat dissipating member arranged between and connecting with the two end caps, the heat dissipating member being a hollow metal tube and comprising a mounting portion and a heat dissipating plate extending from the mounting portion, the mounting portion and the heat dissipating plate cooperatively defining an elongate chamber, the circuit board of the electrical module being accommodated in the chamber of the heat dissipating member, the light source being thermally attached to an outer surface of the mounting portion, heat generated by the LEDs of the light source being absorbed by the mounting portion and transferred to the heat dissipating plate for dissipation; and a hollow electrical insulator accommodated in the chamber of the heat dissipating member, the circuit board being enclosed by the electrical insulator.

2. The LED lamp of claim 1, wherein a portion of an outer surface of the heat dissipating plate is wave-shaped.

3. The LED lamp of claim 1, wherein a portion of an outer surface of the heat dissipating plate forms a plurality of fins thereon.

4. The LED lamp of claim 1, wherein the heat dissipating member is rectangular, the heat dissipating plate comprising two side plates respectively extending perpendicularly from two lateral sides of the mounting portion and a connecting plate connected between ends of the two side plates.

5. The LED lamp of claim 4, wherein an outer surface of each of the side plates of the heat dissipating plate is wave-shaped.

6. The LED lamp of claim 4, wherein a plurality of fins are formed on each of the side plates of the heat dissipating plate.

7. The LED lamp of claim 1, wherein the light-emitting module further comprises a light penetrable cover located above the light source and receiving the light source therein.

8. The LED lamp of claim 7, wherein the light penetrable cover is C-shaped and forms two protrusions at two opposite lateral sides thereof, the mounting portion defining two receiving grooves in the two opposite lateral sides thereof for receiving the two protrusions of the light penetrable cover therein, respectively.

9. The LED lamp of claim 1, wherein each of the end caps comprises a vertical blocking plate, a hollow connecting member and a positioning member formed at an inner side of the blocking plate, the connecting member and the positioning member of each end cap are respectively inserted in the heat dissipating member and the light penetrable cover.

10. An LED lamp, comprising:

a light-emitting module comprising a light source provided with a plurality of LEDs;

an electrical module comprising a circuit board and two end caps, the circuit board being electrically connected with the LEDs of the light source, each of the end caps forming a pair of electrical pin at an outer end thereof; and an elongated heat dissipating member arranged between and connecting with the two end caps, the heat dissipating member being a hollow metal tube and comprising a mounting portion and a heat dissipating plate extending from the mounting portion, the mounting portion and the heat dissipating plate cooperatively defining an elongate chamber, the circuit board of the electrical module being accommodated in the chamber of the heat dissipating member, the light source being thermally attached to an outer surface of the mounting portion, heat generated by the LEDs of the light source being absorbed by the mounting portion and transferred to the heat dissipating plate for dissipation;

wherein each of the end caps comprises a vertical blocking plate, a hollow connecting member and a positioning member formed at an inner side of the blocking plate, the connecting member and the positioning member of each end cap are respectively inserted in the heat dissipating member and the light penetrable cover.

* * * * *